US005440199A

United States Patent [19]

Heindl et al.

[11] Patent Number: 5,440,199

[45] Date of Patent: Aug. 8, 1995

[54] BASE FOR ELECTRODELESS DISCHARGE LAMP

[75] Inventors: Raymond A. Heindl, Euclid; Mark E. Duffy, Shaker Hts.; Frederick Hetzel, North Royalton; David J. Marks, Lakewood; Lawrence T. Mazza, Mayfield Hts.; Curtis E. Scott; Michael M. Secen, both of Mentor, all of Ohio

[73] Assignee: General Electric Company, Schenectady, N.Y.

[21] Appl. No.: 990,204

[22] Filed: Dec. 14, 1992

Related U.S. Application Data

[63] Continuation-in-part of Ser. No. 989,430, Dec. 11, 1992, Pat. No. 5,282,756.

[51] Int. Cl.[6] ..... H01J 5/48

[52] U.S. Cl. ..... 313/318.07; 439/611

[58] Field of Search ..... 313/318, 51; 439/356, 439/336, 615, 616, 611, 619, 612

[56] References Cited

U.S. PATENT DOCUMENTS

| | | | |
|---|---|---|---|
| 2,814,787 | 11/1957 | Jessup . | |
| 3,898,495 | 8/1975 | Livera | 313/51 |
| 4,002,394 | 1/1977 | Cordiano et al. | 439/612 |
| 4,837,479 | 6/1989 | Devir et al. | 439/619 |
| 4,959,584 | 9/1990 | Anderson | 313/160 |
| 5,059,868 | 10/1991 | El-Hamamsy et al. | 315/248 |
| 5,140,227 | 8/1992 | Dakin et al. | 315/248 |
| 5,282,756 | 2/1994 | Heindl et al. | 439/336 |

*Primary Examiner*—Sandra L. O'Shea
*Assistant Examiner*—Vip Patel
*Attorney, Agent, or Firm*—Stanley C. Corwin

[57] ABSTRACT

A base for an electrodeless arc discharge lamp having an elongated tubular stem extending through an outer envelope pinch or press seal includes a pair of electrically non-conductive members secured in mating relation to define an upper cavity and a lower axial bore. The lamp is mounted in the base with its pinch seal secured in the cavity and its stem extending into the bore. With the base mounted in a fixture, RF energy is coupled into the lamp to excite a starting aid in the stem via a conductive bushing in the bore.

19 Claims, 4 Drawing Sheets

Fig. 1(b)
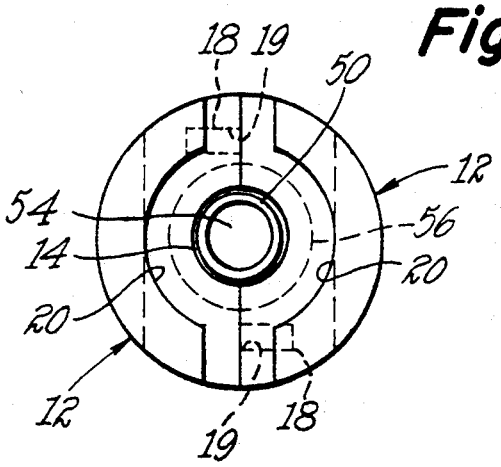
Fig. 1(a)
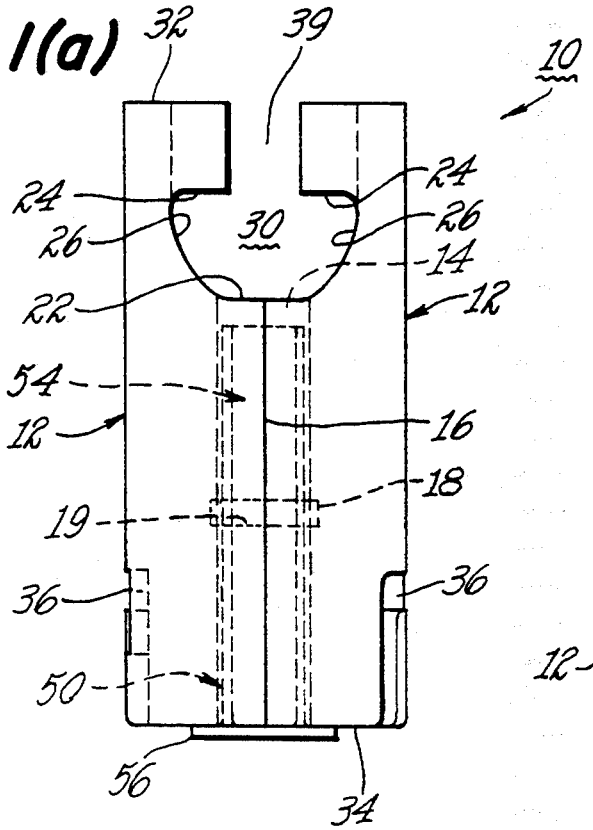
Fig. 1(c)
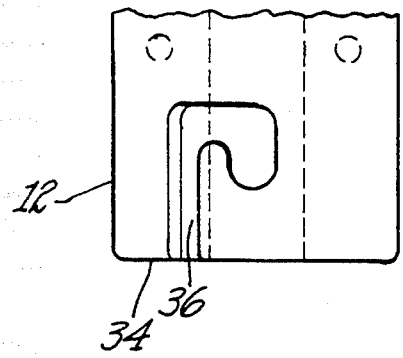
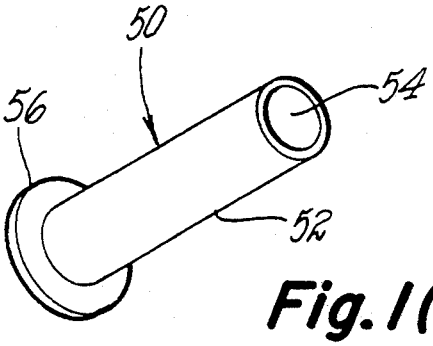
Fig. 1(d)

Fig. 2(a)
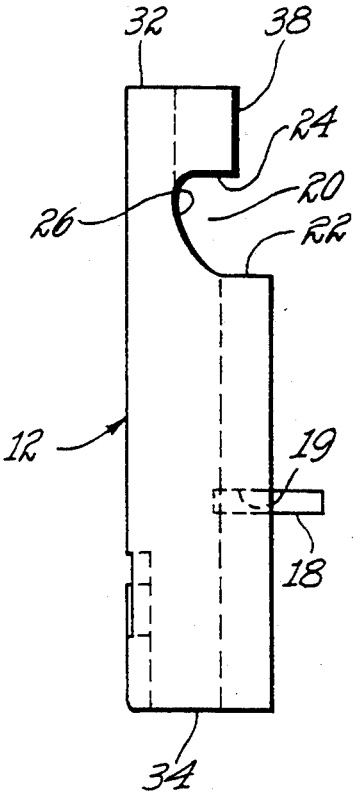
Fig. 2(b)
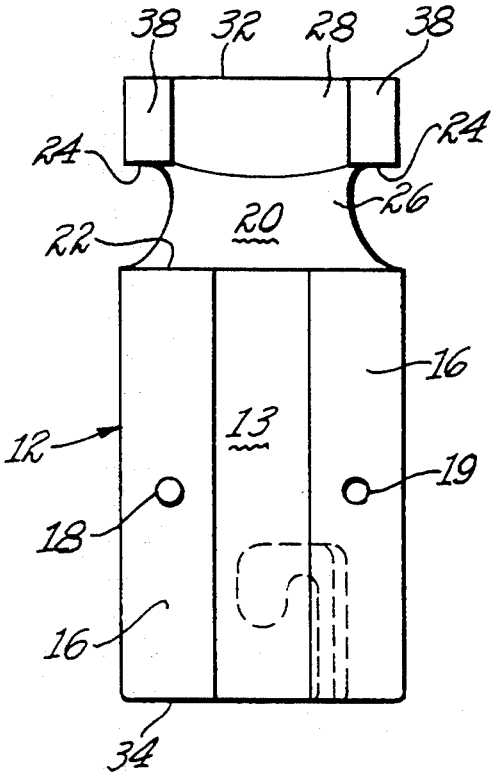
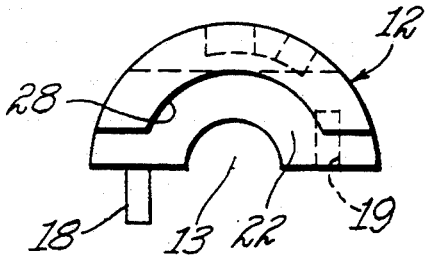
Fig. 2(c)

BASE FOR ELECTRODELESS DISCHARGE LAMP

CROSS REFERENCE TO RELATED APPLICATIONS

This application is a continuation-in-part application of U.S. Ser. No. 989,430, filed Dec. 11, 1992, now issued U.S. Pat. No. 5,282,756.

BACKGROUND OF THE INVENTION

Field of the Invention

This invention relates to an electrically non-conductive base for an electrodeless discharge lamp. More particularly this invention relates to an electrically non-conductive base for an electrodeless arc discharge lamp having an outer envelope press sealed over a tubular lamp stem containing a starting aid, wherein the base is secured, in clamshell fashion, to the press seal portion of the lamp and contains means for coupling RF energy to the starting aid for energizing the lamp.

Background of the Disclosure

High intensity electroded arc discharge lamps such as high pressure sodium lamps and metal halide lamps are well known and include a light-transmissive arc discharge chamber or tube hermetically sealed and enclosing within a pair of spaced apart electrodes and a suitable fill such as an inert starting gas and one or more ionizable metals or metal halides. Two of the major causes of lamp failure are sputtering of electrode material onto the lamp envelope and thermal and electrical stresses which result in electrode failure. More recently a new class of high intensity arc discharge lamps has been developed called electrodeless lamps. Such lamps have a light-transmissive, electrodeless arc chamber or tube generally shaped like a pillbox or oblate spheroid and containing a fill which comprises a suitable inert buffer gas and one or more metal halides. Radio frequency (RF) energy applied or coupled to the fill via capacitive or inductive coupling generates a light-emitting arc. In operation of such a lamp via inductive coupling, the arc tube or chamber acts as a single-turn secondary coil of a transformer and is surrounded by an RF energy excitation coil which acts as a primary coil. Various embodiments of such lamps are disclosed, for example, in U.S. Pat. Nos. 4,810,938; 4,959,584; 5,039,903; 5,059,868 and 5,140,227 all of which are assigned to the assignee of the present invention. The electronics required for starting and sustaining the arc discharge in these lamps is costly and complex and also requires the use of a rather large copper or aluminum inductive drive coil to function as the primary coil for carrying the high frequency current required. Hence some development has been directed toward replaceable electrodeless discharge lamps, particularly of the high intensity type employing one or more metal halides as the arc sustaining fill, wherein the lamp itself is physically separate from both the electronics and the inductive drive coil. One such attempt is disclosed in U.S. Pat. No. 4,959,584 as a luminaire having a replaceable electrodeless, HID metal halide arc discharge lamp wherein the arc chamber is cradled in a thermal jacket which in turn is contained within an outer envelope having a conventional metal screw base with a conductive lead passing through the base to the vicinity of the arc tube. U.S. Pat. No. 5,059,868 discloses an HID electrodeless arc discharge lamp wherein the arc chamber is supported in an outer envelope by means of a support rod which contains an electrical inlead for supplying electricity to the arc chamber in order to start the arc. The arc chamber-outer chamber assembly terminates at one end in a conventional metal base having pins for securing in a socket. However, it is preferable to minimize the amount of metal close to the drive coil, because metal (or any conductor) will pick up energy from the coil which will result in heating the metal and loss of system efficiency.

SUMMARY OF THE INVENTION

The present invention relates to a lamp base suitable for use with a lamp having an envelope closed off by a pinch seal at one end and a tubular stem portion extending beyond the pinch seal and has been found to be useful with electrodeless arc discharge lamps, particularly a high intensity electrodeless arc discharge lamp of such construction. A lamp base of this invention comprises at least two electrically non-conductive members assembled into mating engagement and defining a bore axially extending from one end through a portion of the base and terminating in an upwardly opening cavity provided in a remaining portion of the base, with the cavity in communication with the bore. The cavity has means for retaining the pinch seal portion of the lamp. The lamp is mounted to the base with its envelope pinch seal retained in the cavity and its stem extending into the bore. The bore contains an electrically conductive means for transferring RF energy to the tubular portion of the lamp which extends into the bore. The base has further means for securing the base into a suitable fixture or luminaire. The fixture or luminaire will contain means for coupling RF energy to the lamp and to the conductive means in the base. In most cases the fixture or luminaire contains an RF coil which surrounds the lamp in the vicinity of the arc chamber for which the base of the invention provides accurate alignment of the lamp with respect to the RF coil.

BRIEF DESCRIPTION OF THE DRAWING

FIG. 1 is a schematic illustration of a lamp base of the invention shown assembled in 1(*a*) with 1(*b*) being a top view, 1(*c*) illustrating means for securing the base in a fixture and 1(*d*) illustrating RF energy transfer means.

FIG. 2 schematically illustrates three views of one of two clamping members which form a base of the invention.

DETAILED DESCRIPTION

Figure 3A:
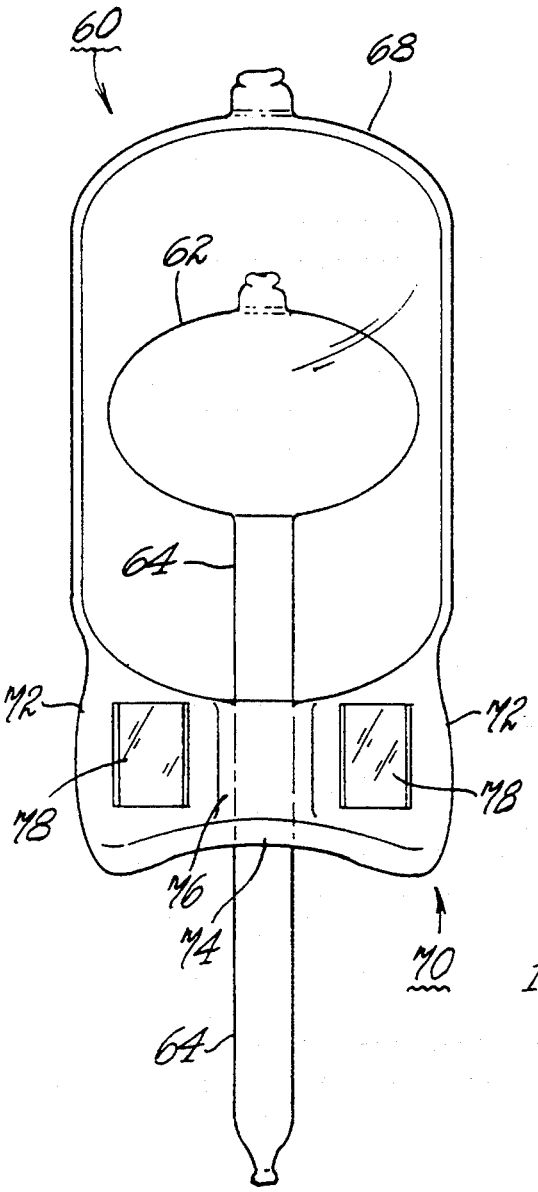
FIG. 3 schematically illustrates a lamp-base assembly according to the invention and a lamp useful with the base.
Figure 3B:
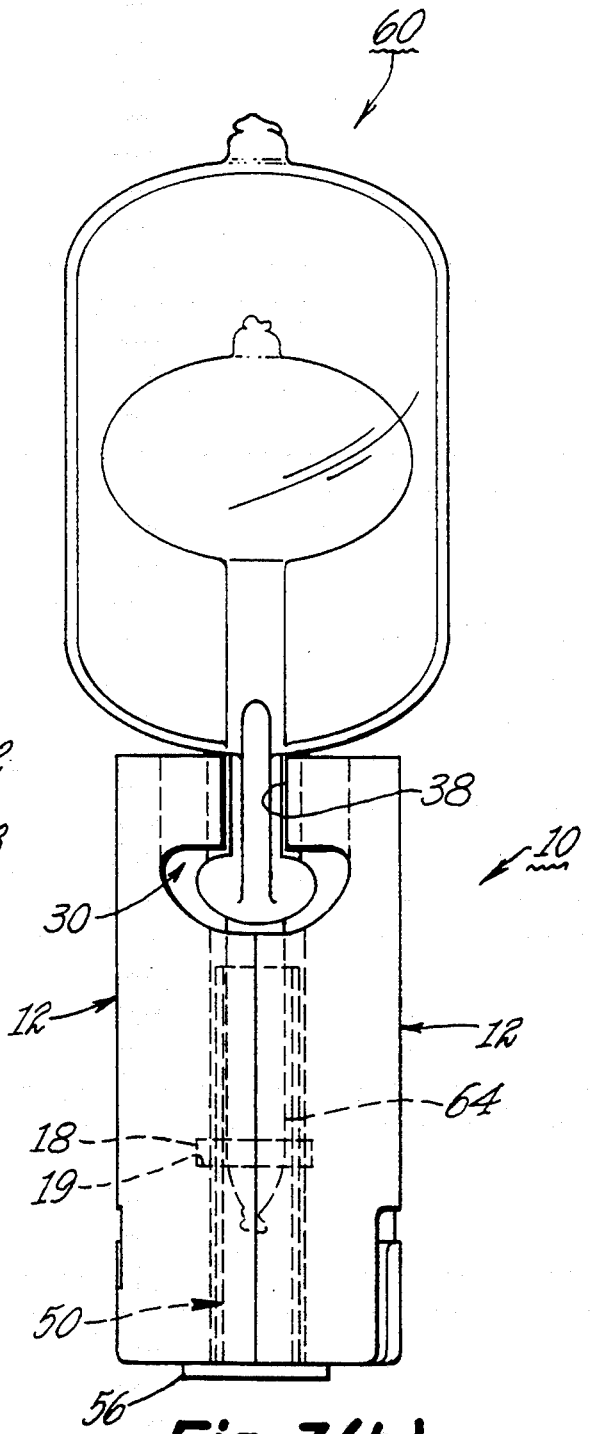
Figure 4B:
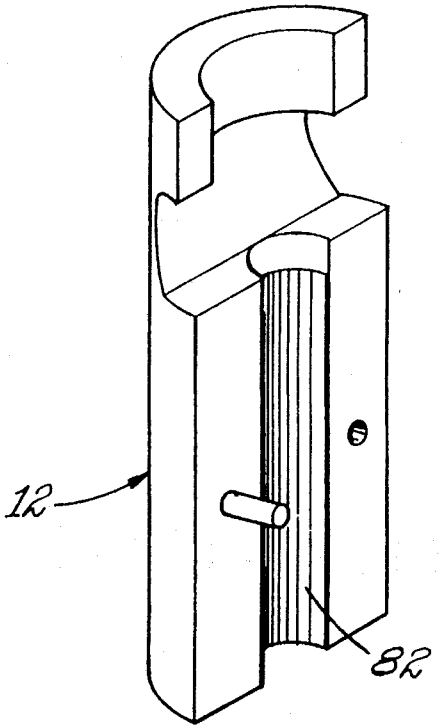
FIGS. 4(*a*) and 4(*b*) schematically illustrate one of two clamping members which form a base of the invention having different embodiments of an RF energy transfer means.
Figure 4A:
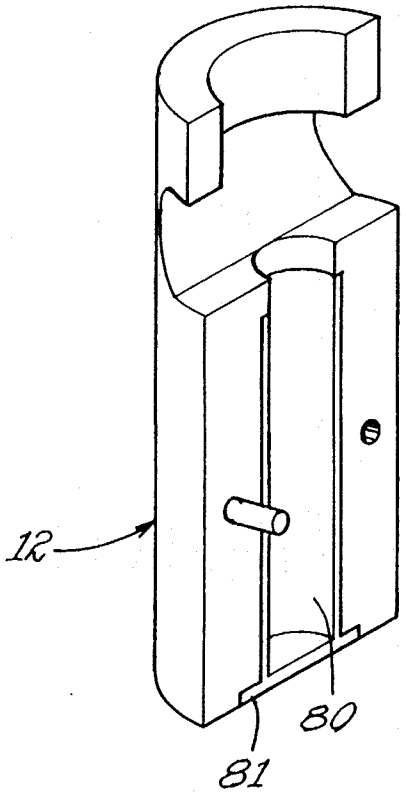

The lamp base of the present invention, generally indicated at 10, is formed by a pair of opposing and cooperating shell-like, semicylindrical (other shapes could be used) members 12, 12 shown in mating engagement as seen in FIG. 1 to form a hollow, cylindrical structure having a top 32 and bottom 34 and a bore 14 in which hollow, conductive metal (e.g., brass) bushing 50 is held. Members 12, 12 are identical and mate with each other along surfaces 16, 16 to form base 10. The shell members are made of a suitable electrically non-conductive and heat-resistant material which includes ceramic materials and plastics such as Delrin, Teflon, polysulfones, liquid crystal polymers, such as Vectra A130 by Celanese Corporation, polyetherimides such as Ultem by GE and polyphenylene sulfides such as Supec by GE and Ryton by Philips. In one embodiment members 12, 12 are made of Delrin (DuPont) and assembled by means of a cavity 19 and a molded-in Delrin pin 18, molded as part of each member 12, so that the mating half 12 contains a matching and opposing hole 19 and pin 18. A thin layer of epoxy adhesive applied to flat surfaces 16, 16 illustrated in FIG. 2 provides a permanent bond. Other suitable means such as ultrasonic welding, thermal welding, other adhesives, mechanical means, etc., may be employed to assemble and secure clamping members 12, 12 to form base 10. Further, although it is preferable that pins 18 be electrically non-conductive, they could be separate and not molded as part of one or both of the members. FIG. 1(*d*) illustrates one embodiment of an RF energy transfer means as a brass or other suitable conductive metal bushing 50 comprising hollow cylindrical portion 52 open at one end and containing bore 54 for receiving stem 64 of lamp 60 as illustrated in FIG. 3(*b*) and flat disk or flange portion 56 at the other end. Disk 56 could have a hole in it instead of being solid as shown so that the bushing 50 would be open at both ends. FIGS. 4(*a*) and 4(*b*) illustrate still further embodiments of an RF energy transfer means, such as an electrically conductive half-bushing 80 molded into cavity 13 of member 12. Mating member 12 will have an identical half-bushing molded into it to form a bushing similar to 50 when the two members are assembled into a base. Although 80 is shown having a half disk or flange 81, it could be merely half a cylinder without a flange. Yet another embodiment is illustrated as a conductive metal plating 82 on the surface of the cavity 13 as illustrated in FIG. 4(*b*). Although not shown in FIG. 4(*b*), conductive plating 82 could extend around the exterior bottom portion of the members in any desired configuration. However, in yet another embodiment, the RF energy transfer means could form a part of a fixture or luminaire, so that when the base lamp assembly is inserted into the fixture or luminaire, a suitable RF energy transfer means forming part of the fixture is inserted into the base cavity 14, and surrounds or contacts at least a portion of lamp stem 64.

As illustrated in FIG. 2, bore 14, which extends through the lower portion of the base, is defined by the mating of the cavities 13 formed in both members 12, 12. The upper end portions of the members beyond cavities 13 and flat surfaces 16 are formed with concavities 20 such that, when mated, the concavities define a large diameter cavity 30 in open communication with bore 14. Immediately above the floor 22 of cavity 30, the opposed edges of the concavities 20 are relieved as indicated at 26, to provide enlarged, diametrically opposed side openings into cavity 30. Member edges 38 above reliefs 26 are set back from flat surfaces 16 such that, with the members mated as seen in FIG. 1(*a*), diametrically opposed slots 39 are provided and interconnect with upper walls 24 of the cavity 30. The upper interior surface of cavity 30 is cylindrical as indicated at 28. While cavity 30 is illustrated as somewhat or at least partially cylindrical in this embodiment, other shapes may be useful to the practitioner.

As seen in FIG. 1(*c*), an L-shaped keyway 36 is formed in the lower portion near the bottom 34 of each member to receive pins or other means serving to secure base 10 in a suitable fixture or luminaire and preferably one equipped to furnish RF energy to the lamp mounted in the base. Other means may be employed to secure the base in a fixture or luminaire, the choice being left to the practitioner.

Turning to FIG. 3, an electrodeless arc discharge lamp 60 is illustrated as comprising hermetically sealed arc chamber 62 to which is attached a hermetically sealed tubular stem portion 64 containing a gaseous fill (not shown) which acts as a starting aid as disclosed in U.S. Pat. No. 5,140,227, the disclosures of which are incorporated herein by reference. Arc chamber 62 is hermetically sealed within a fused quartz outer envelope 68 closed off by means of a hermetic pinch seal 70 formed by pinching one end of 68 closed over tubular stem 64. Tubular stem portion 64 thus extends through pinch seal 70 with its other end closed off by the wall of arc chamber 62 as disclosed in the '227 patent. The medial portion of pinch seal 70 is generally flat having sides 72 and a raised bottom ridge 74 protruding transverse to the longitudinal axis of the lamp 60 as is shown in FIG. 3(*b*). As seen in FIG. 3(*b*), lamp 60 is shown mechanically secured or seated in base 10 by means of cavity 30 around pinch seal 70. Stem 64 extends into bore 14 and into bore 54 of metal bushing 50. Pairs of opposed, raised (or recessed) flats 78 are formed in the pinch seal 70 during the pinch seal molding process in positions such that, with the lamp fully seated, each flat is confronted by or adjacent an edge surface 38 of the base. Flats 78 are molded into both sides of pinch seal 70 and also adjacent both sides of stem seal portion 76. If desired, a suitable adhesive or cement may be applied to bond or cement the four flat surfaces 78 of the pinch seal to each of corresponding lamp base flat surfaces 38 to prevent any movement of lamp 60 within base 10.

The foregoing embodiments are intended to be illustrative, but non-limiting with respect to the practice of the invention. Some departure from these embodiments is permissible within the scope of the invention as those skilled in the art will know and appreciate.

What is claimed is:

1. A lamp base for receiving a sealed end of a lamp envelope and a generally tubular stem portion extending outwardly from the sealed end, the lamp base comprising at least two electrically non-conductive members assembled into mating engagement defining a bore axially extending through a first end of said base and an opening cavity in second end of said base, said cavity configured for retaining a lamp therein and a hollow electrically conductive member disposed in the bore and adapted to receive the sealed end of the lamp envelope therein.

2. A base of claim 1 having a securing assembly to secure said base in an associated fixture.

3. A base of claim 2 wherein the cavity is configured with an enlarged diameter portion and diametrically opposed slots for retaining a press seal portion of a lamp.

4. A base of claim 1 wherein said electrically conductive member comprises a hollow metal cylinder.

5. A base of claim 4 wherein said cylinder comprises two halves, each of which is molded into a respective one of said two electrically non-conductive members.

6. A base of claim 1 wherein said electrically conductive member comprises metal plating on the surface of said bore.

7. A combination as defined in claim 1 wherein the lamp base members include engaging mating members for assembling the base members together.

8. A combination as defined in claim 7 wherein the mating members are defined by a pin in one base member and an opening in the other base member.

9. In combination, a lamp and a lamp base, said lamp having an elongated tubular stem extending through an outer envelope press seal and said base comprising at least two electrically non-conductive members assembled into mating engagement defining a bore axially extending through a lower portion of said base and an upwardly opening cavity in an upper portion of said base, said cavity having means for retaining said seal of said lamp, whereby said lamp seal is secured in said base cavity and said tubular stem extends into said bore.

10. A combination of claim 9 having a keyway in a lower portion of the base for securing said base in a fixture.

11. A combination of claim 10 having electrically conductive means in said bore of said base for providing RF energy to said tubular stem of said lamp.

12. A combination of claim 11 wherein said electrically conductive means comprises a hollow metal cylinder.

13. A combination of claim 12 wherein said cylinder comprises two halves each of which is molded into a respective one of said two members.

14. A combination of claim 10 wherein said electrically conductive means comprises metal plating on the surface of said bore.

15. A combination of claim 11 wherein said lamp comprises an electrodeless, high intensity discharge lamp.

16. A combination of claim 9 wherein said lamp comprises an electrodeless, high intensity discharge lamp.

17. A base for an electrodeless high intensity discharge lamp that includes a light transmissive arc tube defining a chamber that receives a fill containing a suitable inert gas and at least one metal halide that is excited by a radio frequency energy coupled to the fill via capacitive or inductive coupling and an outer envelope that is sealingly received about a major portion of the arc tube except for a tubular portion thereof that extends outwardly from the outer envelope, the base comprising:

first and second non-conductive base members brought together into mating engagement, a first end of the first and second base members having an interior configuration that generally defines an axially extending bore therethrough for receiving the outwardly extending tubular portion of the arc tube, and an enlarged diameter cavity and a pair of diametrically opposed slots opening into the cavity disposed adjacent a second end of the first and second base members for receiving a portion of the outer envelope therein, and an electrically conductive means in the bore facilitating transfer of the radio frequency energy to the tubular portion of the arc tube.

18. A base as defined in claim 17 further comprising an electrically conductive means in the bore for facilitating transfer of the radio frequency energy to the tubular portion of the arc tube.

19. A base as defined in claim 17 further comprising an L-shaped keyway in the second end of the first and second base members for securing the base to an associated fixture.

* * * * *